US006439325B1

(12) United States Patent
Peters et al.

(10) Patent No.: US 6,439,325 B1
(45) Date of Patent: Aug. 27, 2002

(54) DRILLING APPARATUS WITH MOTOR-DRIVEN PUMP STEERING CONTROL

(75) Inventors: Volker Peters, Wienhausen; Detlef Ragnitz, Dassel-Markoldendorf, both of (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/619,327

(22) Filed: Jul. 19, 2000

(51) Int. Cl.[7] ..... E21B 7/04

(52) U.S. Cl. ..... 175/325.5; 175/45; 175/61; 175/73

(58) Field of Search ..... 175/61, 45, 48, 175/73.76, 325.1, 325.5

(56) References Cited

U.S. PATENT DOCUMENTS

| | | | | |
|---|---|---|---|---|
| 4,806,928 A | | 2/1989 | Veneruso | 340/856 |
| 4,901,069 A | | 2/1990 | Veneruso | 340/853 |
| 5,052,941 A | | 10/1991 | Hernandez-Marti et al. | 439/194 |
| 5,278,550 A | | 1/1994 | Rhein-Knudsen et al. | 340/855.1 |
| 5,455,573 A | | 10/1995 | Delatorre | 340/854.8 |
| 5,603,386 A | | 2/1997 | Webster | 175/76 |
| 5,971,072 A | | 10/1999 | Huber et al. | 166/297 |
| 6,206,108 B1 | * | 3/2001 | MacDonald et al. | 175/24 |
| 6,234,259 B1 | * | 5/2001 | Kuckes et al. | 175/73 |

* cited by examiner

*Primary Examiner*—David Bagnell
*Assistant Examiner*—Zakiya Walker
(74) *Attorney, Agent, or Firm*—Madan, Mossman & Sriram, P.C.

(57) ABSTRACT

The present invention provides apparatus for power transfer over a nonconductive gap between rotating and non-rotating members of downhole oilfield tools. The gap may contain a non-conductive fluid, such as drilling fluid or oil for operating hydraulic devices in the downhole tool. The downhole tool, in one embodiment, is a drilling assembly wherein a drive shaft is rotated by a downhole motor to rotate the drill bit attached to the bottom end of the drive shaft. A substantially non-rotating sleeve around the drive shaft includes a plurality of independently operated force application members used to exert the force required to maintain and/or alter the drilling direction. In the preferred system, one or more mechanically operated devices such as hydraulic units control the force application members. A transfer device transfers electrical power between the rotating and non-rotating members, and the electric power is converted directly to mechanical power. An electronic control circuit or unit associated with the rotating member controls the transfer of power between the rotating member and the non-rotating member.

16 Claims, 3 Drawing Sheets

DRILLING APPARATUS WITH MOTOR-DRIVEN PUMP STEERING CONTROL

BACKGROUND OF THE INVENTION

1. Field of the Invention

This invention relates generally to drilling oil wells. More specifically, the invention relates to directional drilling and the use of downhole steering. Even more specifically, the invention relates to an apparatus for transferring power between a rotating member and a non-rotating member of a bottom hole assembly.

2. Description of the Related Art

To obtain hydrocarbons such as oil and gas, boreholes or wellbores are drilled by rotating a drill bit attached to the bottom of a drilling assembly (also referred to herein as a "Bottom Hole Assembly" or "BHA"). The drilling assembly is attached to the bottom of a drill tube, which is usually either a jointed rigid pipe (commonly referred to as the drill pipe) or a relatively flexible spoolable tubing (commonly referred to in the art as the "coiled tubing"). The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud")is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the borehole. The drilling fluid passing through the drilling assembly rotates the mud motor. A drive shaft connected to the motor and the drill bit rotates the drill bit.

It is well known that formations capable of producing significant amounts of oil and gas (hydrocarbons) are increasingly difficult to find. In addition, economic, political and environmental concerns can make it impossible to place a drilling system directly over a promising formation. As a result, a substantial proportion of the current drilling activity involves drilling of deviated and horizontal borehholes to more fully exploit the hydrocarbon reservoirs. In deviated and horizontal drilling, the wellbore is intentionally drilled at an angle from vertical by special downhole drilling tools to guide the drill assembly in the desired direction. These wellbores are drilled to reach a part of a formation or reservoir, which cannot be drilled by a straight or vertical hole because of the environmental, political, or economic reasons mentioned. Such boreholes can have relatively complex well profiles. To drill such complex boreholes, steerable drilling assemblies are sometimes utilized. A particular drilling assembly includes a plurality of independently operable force application members to apply force on the wellbore wall during drilling of the wellbore to maintain the drill bit along a prescribed path and to alter the drilling direction. Such force application members may be disposed on the outer periphery of the drilling assembly body or on a non-rotating sleeve disposed around a rotating drive shaft. These force application members are moved radially outward from the drilling assembly by electrical devices or electro-hydraulic devices to apply force on the wellbore in order to guide the drill bit and/or to change the drilling direction outward. In such drilling assemblies, there exists a gap between the rotating and the non-rotating sections. To reduce the overall size of the drilling assembly and to provide more power to the ribs, it is desirable to locate the devices (such as motor and pump) required to operate the force application members in the non-rotating section. It is also desirable to locate electronic circuits and certain sensors in the non-rotating section. Thus, power must be transferred between the rotating section and the non-rotating section to operate mechanical devices and the sensors in the non-rotating section.

In drilling assemblies which do not include a non-rotating sleeve as described above, it is desirable to transfer electrical and mechanical power between the rotating drill shaft and the stationary housing surrounding the drill shaft. The power transferred to the rotating shaft may be utilized to operate sensors or mechanical devices in the rotating shaft and/or drill bit. Power transfer between rotating and non-rotating sections having a gap therebetween can also be useful in other downhole tool configurations.

The present invention, which is especially desirable in a space-restrictive application such as the drilling of very small deviated boreholes, provides contactless inductive coupling to convert electrical power in one section to mechanical power in another section where the sections are rotating and non-rotating sections of downhole oilfield tools, including the drilling assemblies containing rotating and non-rotating members. This direct transfer and conversion has the desirable characteristic of requiring fewer components than other tools that transfer electrical power to operate electrically controlled devices to perform mechanical functions such as operating pumps. Direct conversion means fewer parts, thus leading to more economical, reliable and compact tool designs.

SUMMARY OF THE INVENTION

In general, the present invention provides apparatus for power transfer over a nonconductive gap between rotating and non-rotating members of downhole oilfield tools. The gap may contain a non-conductive fluid, such as drilling fluid or oil for operating hydraulic devices in the downhole tool. The downhole tool, in one embodiment, is a drilling assembly wherein a drive shaft is rotated by a downhole motor to rotate the drill bit attached to the bottom end of the drive shaft. A substantially non-rotating sleeve around the drive shaft includes a plurality of independently operated force application members, wherein each such member is adapted to be moved radially between a retracted position and an extended position. The force application members are operated to exert the force required to maintain and/or alter the drilling direction. In the preferred system, one or more mechanically operated devices such as hydraulic units provide energy (power) to the force application members. A transfer device transfers electrical power between the rotating and non-rotating members, and the electric power is converted directly to mechanical power. An electronic control circuit or unit associated with the rotating member controls the transfer of power between the rotating member and the non-rotating member.

In a preferred embodiment, the present invention is particularly suited for a Rotary Closed-Loop System (RCLS) type tool for drilling deviated boreholes with very small hole sizes. A RCLS system is an automated directional drilling system that contains its own programmed controller and steering sub, and drills continuously in the rotary mode. A non-rotating, orienting sleeve controls steering expanding force application members. Precisely controlled force on the force application members produces resultant force vectors that maintain inclination alignment and direction within the program well path. Course corrections are made continuously while drilling, with no trips required for tool adjustments. Real-time surface monitoring permits changes to the wellpath program if desired. This technology increases the rate-of-penetration, improves hole quality, and enables greater extended reach capability. The embodiment may also comprise measurement while drilling (MWD), geosteering and automated rotary drilling capability.

In general, one or more steering ribs are controlled by hydraulic pressure. A motor located on the rotating shaft of a bottom hole assembly driving an axial piston pump in the non-rotating sleeve manages the generation of hydraulic pressure. The motor windings are positioned on the rotating shaft and a magnetically polarized rotor is located on the non-rotating sleeve. There would be one motor for controlling a hydraulic pump for each steering rib. Rotation control of the motor controls the variable piston pressure, and no electrical transmission to the sleeve is required to control the ribs. In the preferred embodiment, the motor will run in drilling mud. Feedback regarding the position of the non-rotating sleeve will be measured by sensors in the non-rotating sleeve or by markers. These methods of feedback and the sensors required are well known in the art. An added benefit of this arrangement is that no hydraulic pressure has to be transmitted from the rotating shaft to the sleeve.

In an alternative embodiment of the invention, a power transfer device transfers power from the non-rotating housing to the rotating drill shaft. The power transferred to the rotating drill shaft is directly converted to electrical power to operate one or more sensors or electrically operated devices in the drill bit and/or the bearing assembly.

The power transfer device may also be provided in a separate module above the mud motor to transfer power from a non-rotating section to the rotating member of the mud motor and the drill bit. The power transferred may be utilized to operate devices and sensors in the rotating sections of the drilling assembly, such as the drill shaft and the drill bit.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENT

Figure 1A:
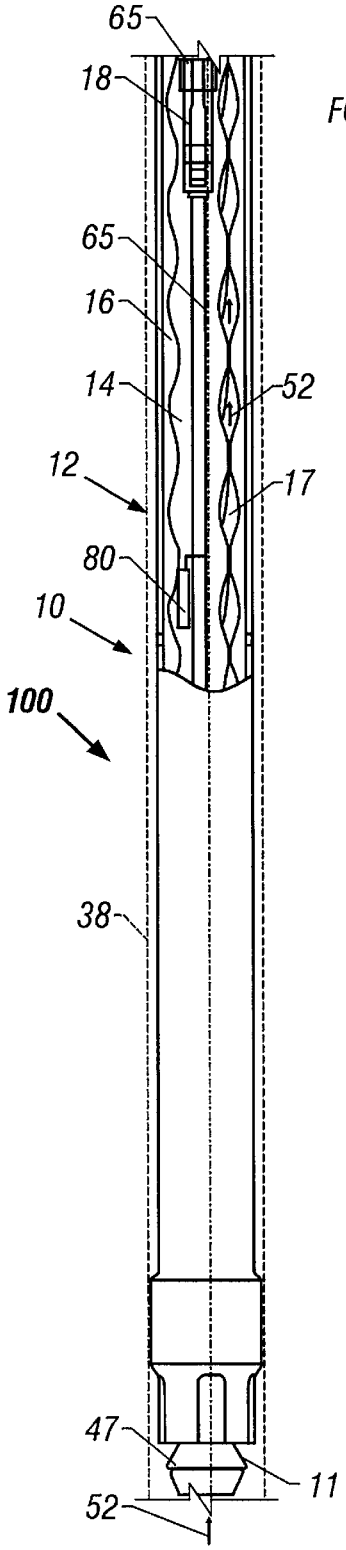
FIGS. 1A–1B show a cross-sectional view of a portion of the drilling assembly with the steering device and the control device disposed in the bearing assembly of the drilling assembly.
Figure 1B:
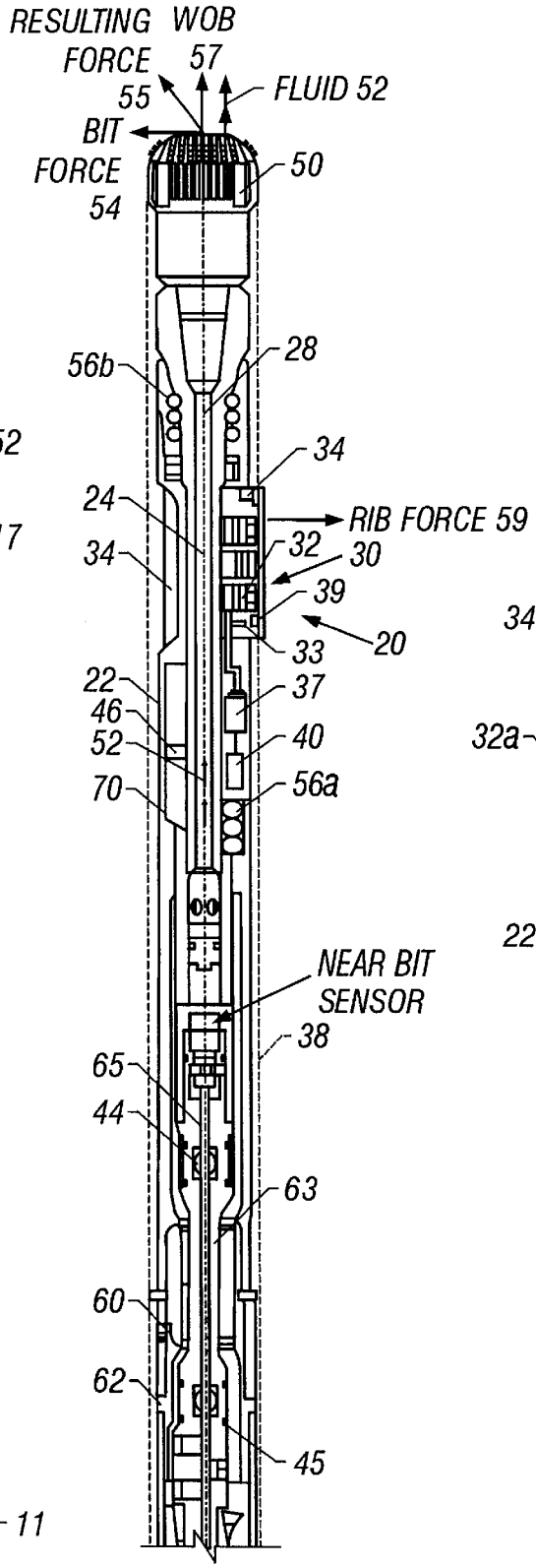
Figure 3:
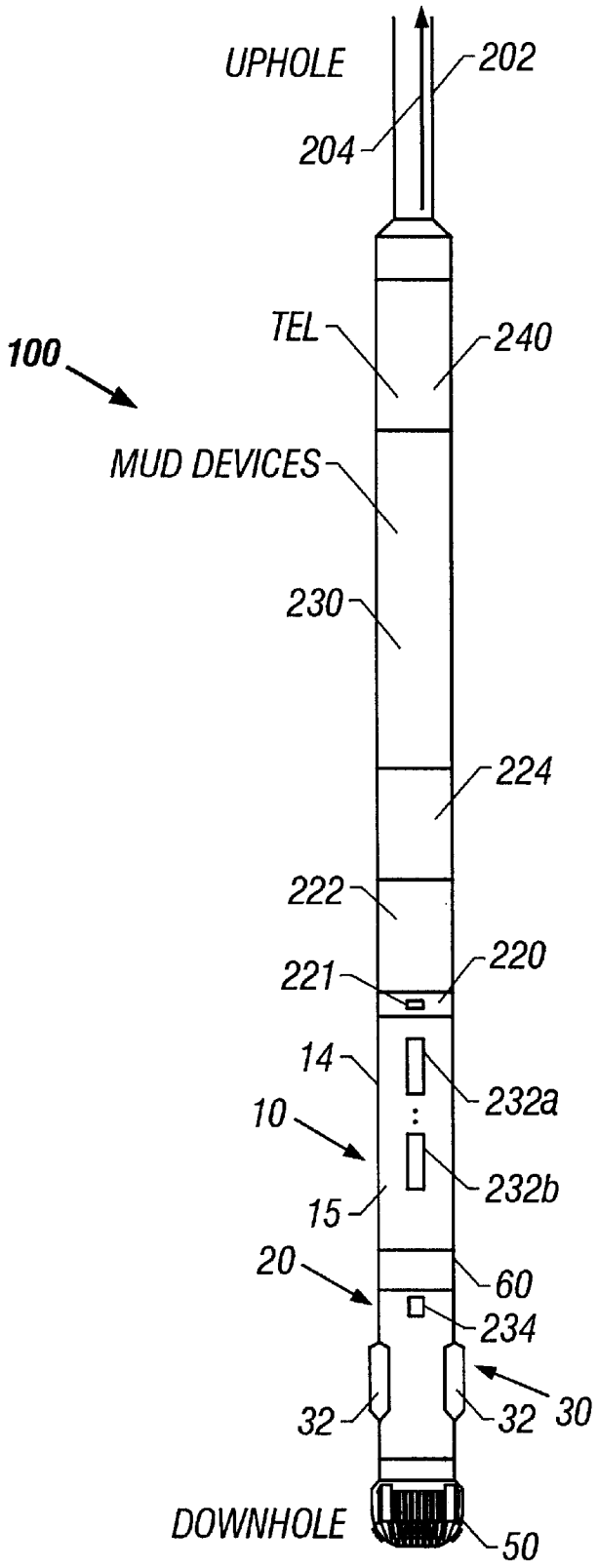
FIG. 3 is a schematic view of an embodiment of the drilling assembly according to the present invention.

FIGS. 1A–1B show a schematic diagram of a steering device 30 integrated into a bearing assembly 20 of a drilling motor 10. The drilling motor 10 forms a part of the drilling assembly 100 (FIG. 3). The drilling motor 10 contains a power section 12 and the bearing assembly 20. The power section 12 includes a rotor 14 that rotates in a stator 16 when a fluid 52 under pressure passes through a series of openings 17 between the rotor 14 and the stator 16. The fluid 52 may be a drilling fluid or "mud" commonly used for drilling wellbores or it may be a gas or liquid and gas mixture. The rotor 14 is coupled to a rotatable shaft 18 for transferring rotary power generated by the drilling motor 10 to the drill bit 50.

Figure 2:
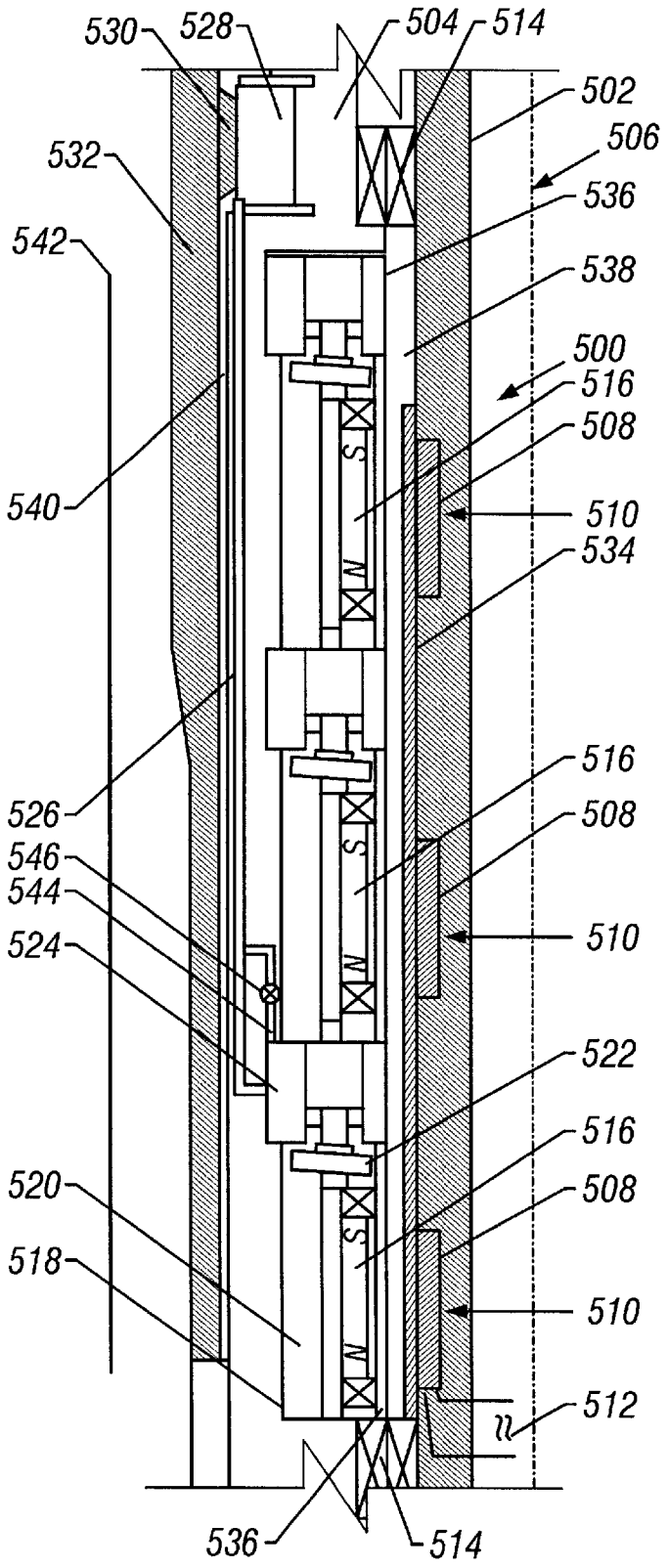
FIG. 2 is a detailed cutaway schematic view of an embodiment of the present invention wherein the stator is disposed on a rotating shaft and the rotor is disposed on the non-rotating sleeve in a bottom hole assembly including one steering member.

The bearing assembly 20 has an outer housing 22 and a through passage 24. A drive shaft 28 disposed in the housing 22 is coupled to the rotor 14 via the rotatable shaft 18. The drive shaft 28 is connected to the drill bit 50 at its lower or downhole end. During drilling of the wellbores, drilling fluid 52 causes the rotor 14 to rotate, which rotates the shaft 18, which in turn rotates the drive shaft 28 and hence the drill bit 50. It is important not to confuse the terminology associated with the drill motor 10 and the electromagnetic motor 510 (FIG. 2). The terms rotor and stator are used in reference to each motor, and those skilled in the art are aware of the physical and operational differences between the two motors.

Continuing with FIGS. 1A–1B, the bearing assembly 20 contains within its housing 22 suitable radial bearings 56*a* that provide lateral or radial support to the drive shaft 28 and the drill bit 50, and suitable thrust bearings 56*b* to provide axial (longitudinal or along the wellbore) support to the drill bit 50. The drive shaft 28 is coupled to the shaft 18 by a suitable coupling 44. The shaft 18 is a flexible shaft to account for the eccentric rotation of the rotor. Any suitable coupling arrangement may be utilized to transfer rotational power from the rotor 14 to the drive shaft. During the drilling of the wellbores, the drilling fluid 52 leaving the power section 12 enters the through passage 24 of the drive shaft 28 at ports or openings and discharges at the drill bit bottom 53. Various types of bearing assemblies are known in the art and are thus not described in greater detail here.

Figure 1C:
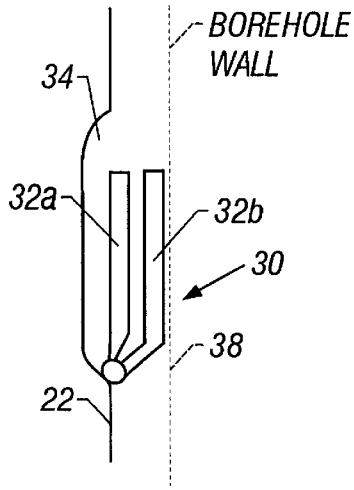
FIG. 1C shows a rib of the steering device of FIG. 1A in the retracted and extended positions.

In the preferred embodiment of FIGS. 1A–1B, a steering device, generally represented by numeral 30 is integrated into the housing 22 of the bearing assembly 20. The steering device 30 includes a number of force application members 32. Each force application member is preferably placed in a reduced diameter section 34 of the bearing assembly housing 22. The force application members may be ribs or pads. For the purpose of this invention, the force application members are generally referred herein as the ribs. Three ribs 32 equally spaced in or around the outer surface of the housing 22, have been found to be adequate for properly steering the drill bit 50 during drilling operations. Each rib 32 is adapted to be extended radially outward from the housing 22. FIG. 1C shows a rib 32 in its normal position 32*a*, also referred to as the retracted or collapsed position, and in a fully extended position 32*b* relative to the borehole inner wall 38. A separate piston pump 40 independently controls the operation of each steering rib 32. For short radius drilling assemblies, each such pump 40 is preferably an axial piston pump 40 disposed in the bearing assembly housing 22.

Still referring to FIGS. 1A–1B, it is known that the drilling direction can be controlled by applying a force on the drill bit 50 that deviates from the axis of the borehole tangent line. This can be explained by use of a force parallelogram depicted in FIG. 1A. The borehole tangent line is the direction in which the normal force or pressure is applied on the drill bit 50 due to the weight on bit, as shown by the arrow WOB 57. A side force applied to the drill bit 50 by the steering device 30 creates a force vector that deviates from the borehole tangent line. If a side force or rib force such as that shown by arrow 59 is applied to the drilling assembly 100, it creates a force 54 known as bit force on the drill bit 50. The resulting force vector 55 then lies between the weight-on bit and bit force lines depending upon the amount of applied rib force.

The present invention is particularly suited for so-called closed-loop drilling systems for drilling small diameter deviated boreholes. The closed-loop drilling systems usually are automated directional drilling systems that contain their own programmed controller and steering mechanisms which can effect continuously controlled drilling of deviated holes. In one type of drilling assembly used in closed-loop drilling systems, a precisely controlled force on the expanding pads (or ribs) produces resultant force vectors that maintain inclination alignment and direction within the programmed well path. Course corrections are-made either periodically or continuously while drilling, with no trips required for tool adjustments. Real-time surface monitoring permits changes to the wellpath program if desired. This technology increases the rate-of-penetration, improves hole quality, and enables greater extended reach capability. This embodiment will be explained in detail later with reference to FIG. 2. In general, one or more, and preferably three, steering ribs are controlled by hydraulic pressure. A motor located on the rotating shaft of a bottom hole assembly driving an axial piston pump in the non-rotating sleeve manages the generation of hydraulic pressure. The motor windings are positioned on the rotating shaft and a magnetically polarized rotor is located on the non-rotating sleeve. Preferably, there would be one motor for controlling a hydraulic pump for each steering rib. However, one motor could also control multiple pumps and one pump could control multiple steering ribs. Rotation control of the motor controls the variable piston pressure, and no electrical transmission to the sleeve is required to control the ribs. In the preferred embodiment, the motor will run in drilling mud. Feedback regarding the position of the non-rotating sleeve will be measured by sensors in the non-rotating sleeve or by markers. These methods of feedback and the sensors required are well known in the art. An added benefit of this arrangement is that no hydraulic pressure has to be transmitted from the rotating shaft to the sleeve.

Referring now to FIG. 2 for a more detailed description of the preferred embodiment, a schematic of a portion of the BHA 500 is shown which comprises a rotating member or shaft 502 and a non-rotating sleeve 504. The non-rotating sleeve 504 and rotating shaft 502 are coupled via bearings 514, which may be mud-lubricated. The BHA 500 includes a plurality of electric motors 510. In this embodiment the motors 510 are used to control the deployment and retraction of a plurality of steering ribs 532, one of which is shown in the figure. Each motor 510 comprises a stator 508 and a magnetically polarized rotor 516. Each rotor 516 is rotatably disposed in or on the non-rotating sleeve 504 such that the rotor 516 can provide rotational movement relative to forces generated by the reaction between the rotor magnetic field and electric current in windings of the stator 508. The stator 508 and rotor 516 are separated by an electrically nonconductive gap 538, which can be filled with non-conductive drilling mud or oil. To protect the stator 508 a shield 534 is placed between the stator 508 and gap 538. In the figure, a rotating shaft 502 rotating about the centerline 506 of the BHA assembly 500 has a plurality of stators 508 disposed thereon. The stators 508 may be any suitable conductive winding material. Electric sinusoidal power 512 is supplied to each stator 508 by a controller (not shown). The controller is capable of varying the magnitude of current supplied to each stator 508, and each stator current is independently controlled with respect to the current supplied to other stators. A processor (not shown) may be integrated into the controller or located at a suitable location on the string down hole or even on the surface. The processor would include the drilling profile. One or more sensors mounted on the BHA 500 would send data relating the orientation of the BHA and the direction of drilling to the processor. The processor would, in turn, adjust the controller current based on the feedback from the sensors. The controller adjustments would result in the modification of current levels being sent to stators 508. The actual operational and component descriptions of the motors are not sufficiently different, so the description herein is limited to the description of one motor.

When an alternating sinusoidal current, generally referred as ac current or simply current, energizes stator 508, the current flows through the windings of the stator. The magnetic field of the rotor 516 propagates across the gap 538 and encompasses the stator 508. Forces imparted on the charged particles (current) in the stator loops are met with equal forces in the opposite direction from the charged particles. Since the rotor is rotatably mounted and the stator is not, the magnetically polarized rotor 516 then is forced into movement. The forces of this action are proportional to the amount of current supplied to the stator 508 as well as the rotational speed of the rotating shaft 502 and the intensity of the magnetic field of the rotor. Thus, controlling the current supplied to the stator 508 or the rotational speed of the shaft 502 controls the force (or mechanical power) of the rotor 516. Since the rotational speed of the shaft is typically dictated by parameters such as desired rate of penetration (ROP), formation material, type of drill bit used etc, varying the controller output current is used to maintain a desired power output of the motor. To do this, feedback sensors detecting the rotational speed of the shaft 502 would be required to send the data to the processor. The processor would process the shaft data along with other data to vary the controller current accordingly. As the current supplied by the controller to the stator 508 changes polarity, the forces between the rotor and charged particles within the stator windings reverse direction thereby forcing the rotor 516 to realign again. The continuous reversal of polarity of current in the windings of the stator 508 forcing the rotor to continuously realign creates rotational mechanical power in the rotor 516. This mechanical power may be utilized in any desired application requiring mechanical power. In this embodiment, the mechanical rotor power is used to drive a pump 524. The pump 524 is preferably an axial piston pump, and it is used to hydraulically control the deployment of a steering rib 532. When supplying deployment force to rib 532, the pump supplies hydraulic fluid 520 by drawing the fluid 520 from a sealed fluid reservoir 518. The pump 524 is connected to fluid line 526, and the fluid line 526 is connected to an extensible member (piston) fluid chamber 528. A piston 530 movably connected to the piston fluid chamber 528 either extends or retracts relative to the pressure supplied by the fluid 520 entering or exiting the piston fluid chamber 528. The rib 532, disposed in recessed section 540 is positioned between the borehole wall 542 and the piston 530. The extension or retraction of the piston 530 controls the radial movement of the rib 532.

As the rotor 516 begins to rotate due to the presence of the alternating stator current, the pump 524 connected to the rotor 516 begins to operate. The pump operation pressurizes the fluid line 526 with the hydraulic fluid 520. When the pump 524 pressurizes the fluid line 526, fluid 520 passes from the reservoir 518 via the fluid line 526 and on to the piston fluid chamber 528. The piston fluid chamber 528 fills with fluid 520 and pressurizes relative to the power supplied by the rotor 516. When the pressure rises, the piston 530 extends thereby extending the rib 532. The extended rib 532 thus supplies a force to the borehole wall 542. This exerted force tends to direct the BHA 500 in a direction opposite from the direction of the force being supplied against the borehole wall 542. The rotating drill bit (not shown in this figure) then begins to deviate from the vertical thereby drilling along a path controlled by the rib steering mechanism of the present invention. As stated above, three ribs independently controlled and equally spaced on or about the BHA 500 in this manner would be sufficient to adequately control the drilling path for deviated boreholes. This is accomplished by independently controlling the force applied to the borehole wall 542 in a combination of three directions and varying magnitudes as described above with respect to the parallelogram in FIG. 1B.

When retraction of a steering rib is desired, the current being supplied is reduced or terminated by the processor and controller to deactivate the pump 524. With the pump 524 deactivated, the fluid 520 in the piston fluid chamber 528 returns to the sealed reservoir 518. There are multiple hydraulic methods well known in the art for accomplishing the depressurization of hydraulic systems, and any suitable arrangement may be utilized. One such arrangement has the fluid returning to the reservoir via a separate fluid return line 544 through a bleed valve 546. Axial piston pumps may also have a bleed valve (not shown) to relieve the pressure from the fluid line.

FIG. 3 shows a configuration of a drilling assembly 100 utilizing the steering device 30 (see FIGS. 1A–1B and 2) of the present invention in the bearing assembly 20 coupled to a coiled tubing 202. The drilling assembly 100 has the drill bit 50 at the lower end. As described earlier, the bearing assembly 20 above the drill bit 50 carries the steering device 30 having a number of ribs that are independently controlled to exert desired force on the drill bit 50 during borehole drilling. An inclinometer (z-axis) 234 is preferably placed near the drill bit 50 to determine the inclination of the drilling assembly. The mud motor 10 provides the required rotary force to the drill bit 50 as described earlier with reference to FIGS. 1A–1B. A knuckle joint 60 may be provided between the bearing assembly 20 and the mud motor 10. Depending on the drilling requirements, the knuckle joint 60 may be omitted or placed at another suitable location in the drilling assembly 100. A number of desired sensors, generally denoted by numerals 232*a*–232*n* may be disposed in a motor assembly housing 15 or at any other suitable place in the assembly 100. The sensors 232*a*–232*n* may include a resistivity sensor, a gamma ray detector, and sensors for determining borehole parameters such as the fluid flow rate through the drilling motor 10, pressure drop across the drilling motor 10, torque on the drilling motor 10, and speed of the motor 10.

The control circuit 80 may be placed above the power section 12 to control the operation of the steering device 30. A slip ring transducer 221 may also be placed in the section 220. The control circuits in the section 220 may be placed in a rotating chamber, which rotates with the motor 10. The drilling assembly 100 may include any number of other devices. It may include navigation devices 222 to provide information about parameters that may be utilized downhole or at the surface to control the drilling operations and/or the azimuth. Flexible subs, release tools with cable bypass, generally denoted herein by numeral 224, may also be included in the drilling assembly 100. The drilling assembly 100 may also include any number of additional devices known as measurement-while-drilling devices or logging-while-drilling devices for determining various borehole and formation parameters, such as the porosity of the formation, density of the formation, and bed boundary information. The electronic circuitry that includes microprocessors, memory devices and other required circuits is preferably placed in the section 230 or in an adjacent section (not shown). A two-way telemetry 240 provides two-way communication of data between the drilling assembly 100 and the surface equipment. Conductors 65 placed along the length of the coiled tubing may be utilized to provide power to the downhole devices and the two-way data transmission.

The downhole electronics in the section 220 and/or 230 may be provided with various models and programmed instructions for controlling certain functions of the drilling assembly 100 downhole. A desired drilling profile may be stored in the drilling assembly 100. During drilling, data/signals from the inclinometer 234 and other sensors in the sections 220 and 230 are processed to determine the drilling direction relative to the desired direction. The control device, in response to such information, adjusts the force on force application members 32 to cause the drill bit 50 to drill the borehole along the desired path. Thus, the drilling assembly 100 of the present invention can be utilized to drill short-radius and medium radius boreholes relatively accurately and, if desired, automatically.

An alternative embodiment may have the motor components located on the BHA, such that electrical power is generated in the non-rotating sleeve by the use of mechanical power in the rotating portion of the BHA. In this configuration electric motor stators are disposed on or about the non-rotating sleeve. A plurality of rotors is disposed about the rotating shaft. The constantly rotating magnetic field of the rotors creates an electrical current in the stator windings. This electric power can be conditioned and controlled to operate electrical devices in the non-rotating sleeve.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A drilling assembly for use in drilling a wellbore, comprising:

(a) a rotating member;

(b) a non-rotating member placed around the rotating member with a gap therebetween;

(c) an inductive stator carried by said rotating member; and (d) a rotor carried by said non-rotating member, said rotor rotating upon receiving power from said stator during drilling of said wellbore.

2. The drilling assembly of claim 1, wherein said non-rotating member is a sleeve and said rotating member is a drive shaft rotatably disposed in said non-rotating sleeve.

3. The drilling assembly of claim 1, wherein said rotor is a magnetic rotor for receiving electrical power from said stator and converting said electrical power to rotary mechanical power.

4. The drilling assembly of claim 3 further comprising at least one mechanically operated device for performing a function downhole, said device being powered by said rotor.

5. The drilling assembly of claim 1 further comprising:

(i) a steering member;

(ii) a piston for providing power to said steering member to cause said steering member to move outward from said drilling assembly; and (iii) a pump driven by said rotor to supply fluid under pressure to said piston to move said steering member.

6. The drilling assembly of claim 5, wherein said rotor, pump and fluid are integrated into a sealed module.

7. The drilling assembly of claim 1 further comprising a control system that controls the current supply to said stator to control the rotation of the rotor.

8. The drilling assembly of claim 1 further comprising a drilling motor that rotates the rotating member.

9. The drilling assembly of claim 8, wherein said drilling motor is operated upon supply of drilling fluid under pressure to said drilling assembly.

10. The drilling assembly of claim 1 wherein said gap is filled with a non-conductive fluid.

11. The drilling assembly of claim 10 wherein said non-conducting fluid is selected from the group consisting of (i) oil and (ii) drilling mud.

12. A drilling assembly for drilling a wellbore, comprising:

(a) a rotating member for rotating a drill bit;

(b) a non-rotating member placed around said rotating member, said non-rotating member having a plurality of force application members that are adapted to move radially outward from said non-rotating member when power is supplied to such force application members;

(c) at least one motor having a rotor carried by said non-rotating member and a stator carried by said rotating member, said stator causing the rotor to rotate upon supply of electrical current to the stator; and (d) at least one pump operated by said rotor for supplying power to said force application members.

13. The drilling assembly of claim 12, wherein the at least one pump supplies fluid under pressure to each said force application member via a separate fluid line.

14. The drilling assembly of claims 13, wherein a separate fluid flow valve in each fluid line controls the supply of fluid to a separate force application member.

15. The drilling assembly of claim 12 further comprising a plurality of downhole sensors for determining parameters of interest.

16. The drilling assembly of claim 15 wherein said plurality of downhole sensors further comprise:

(i) an inclinometer for measuring the inclination of said drilling assembly;

(ii) a plurality of torque sensors for measuring torque on downhole components;

(iii) a resistivity sensor for measuring formation parameters; and (iv) a gamma-ray detector for measuring formation parameters.

* * * * *